US009549249B2

(12) United States Patent
Sontacchi et al.

(10) Patent No.: US 9,549,249 B2
(45) Date of Patent: Jan. 17, 2017

(54) HEADPHONE FOR ACTIVE NOISE SUPPRESSION

(71) Applicant: AKG Acoustics GmbH, Vienna (AT)

(72) Inventors: Alois Sontacchi, Gratwein (AT); Robert Höldrich, Graz (AT); Markus Flock, Graz (AT)

(73) Assignee: AKG Acoustics GmbH, Vienna (AT)

( * ) Notice: Subject to any disclaimer, the term of this patent is extended or adjusted under 35 U.S.C. 154(b) by 545 days.

(21) Appl. No.: 13/922,950

(22) Filed: Jun. 20, 2013

(65) Prior Publication Data

US 2013/0343557 A1 Dec. 26, 2013
US 2016/0353202 A9 Dec. 1, 2016

(30) Foreign Application Priority Data

Jun. 20, 2012 (EP) ..... 12450035

(51) Int. Cl.
*G10K 11/16* (2006.01)
*H04R 3/00* (2006.01)
(Continued)

(52) U.S. Cl.
CPC ..... *H04R 3/002* (2013.01); *H04R 1/1083* (2013.01); *G10K 11/178* (2013.01); *G10K 11/1782* (2013.01); *G10K 2210/30391* (2013.01)

(58) Field of Classification Search
CPC ..... G10K 11/178; G10K 11/1782; G10K 2210/30391; H04R 1/1083
(Continued)

(56) References Cited

U.S. PATENT DOCUMENTS 5,649,018 A 7/1997 Gifford et al.
6,360,203 B1 * 3/2002 Prince ..... 704/270
(Continued)

FOREIGN PATENT DOCUMENTS

WO WO 2007/011337 A1 1/2007
WO WO 2009/134107 A2 5/2009

OTHER PUBLICATIONS

European Patent Office—European Search Report for Application No. EP 12 45 0035 dated Nov. 30, 2012, pp. 7.
(Continued)

*Primary Examiner* — Disler Paul
(74) *Attorney, Agent, or Firm* — Brooks Kushman P.C.

(57) ABSTRACT

The disclosed active noise suppression headphone system is directed to a headphone system that is capable of substantially suppressing high or low frequency interfering noise that penetrate through a headphone earpiece from multiple directions. An external microphone mounted with a housing of a headphone earpiece senses ambient noise outside of the earpiece. The sensed ambient noise may be processed through at least one parallel filter bank arranged in at least one headphone earpiece. Each parallel filter bank may include adaptively linked filters. The output of these filters may be amplified based on weighting factors that are dependent upon the sensed ambient noise and that are generated by a filtered x least mean square circuit. The amplified filtered outputs may be summed to generate an antinoise signal that is in input to a loudspeaker within the headphone earpiece that substantial suppresses the ambient noise before it can be perceived by an end user of the headphones.

13 Claims, 6 Drawing Sheets

(51) Int. Cl.
*H04R 1/10* (2006.01)
*G10K 11/178* (2006.01)

(58) Field of Classification Search
USPC ..... 381/71.1–71.9, 71.11–71.12
See application file for complete search history.

(56) References Cited

U.S. PATENT DOCUMENTS 6,449,369 B1 * 9/2002 Carme ..... G10K 11/1784 381/71.12
8,718,291 B2 * 5/2014 Alves ..... G10K 11/1784 381/71.11
2003/0185403 A1 10/2003 Sibbald
2005/0169495 A1 8/2005 Almqvist
2012/0269363 A1 * 10/2012 Suvanto ..... 381/107
2014/0270225 A1 * 9/2014 Gether ..... G10K 11/1788 381/71.6

OTHER PUBLICATIONS

Song, Ying, Gong, Yu, and Kuo, Sen M., "A Robust Hybrid Feedback Active Noise Cancellation Headset", IEEE Transactions on Speech and Audio Processing, vol. 13, No. 4, Jul. 4, 2005, pp. 607-617.
Kuo, Sen M. and Morgan, Dennis R. "Active Noise Control: A Tutorial Review", *Proceedings of the IEEE*, vol. 87, No. 6, Jun. 1999, pp. 943-973.

* cited by examiner

HEADPHONE FOR ACTIVE NOISE SUPPRESSION

PRIORITY CLAIM

This application claims the benefit of priority from European Patent Application No. EP12450035, filed Jun. 20, 2012, which is incorporated by reference.

BACKGROUND OF THE INVENTION

1. Technical Field

This invention relates to audio headphones, and more particularly, audio headphones having active noise suppression.

2. Related Art

Headphones are worn by an end user to enable the user to listen to audio, such as music or speech, and to listen to other useful signals. Earpieces of some headphones include components or elements to dampen or reduce the interfering effect of ambient noise, such as noises occurring at a construction site, road noises, or noises occurring around or within a vehicle. While some of these headphones dampen or reduce high-frequency ambient noise they still permit low-frequency ambient noise to enter the earpiece undampened.

Other headphones are configured such that an earpiece loudspeaker actively outputs a signal that is substantially inverse to the noise penetrating from the outside of the earpiece so that the low frequency noise is substantially canceled out before the noise enters the end user's ear. Some active noise suppressing headphones include microphones that are generally arranged on a front outside portion of one or both headphone ear pieces. These headphones operate on surrounding ambient noise through the external microphones and a separate control unit in combination with a radio and a number of control buttons. Other active noise suppressing headphones sense ambient noise with an external microphone and compensate for the sensed ambient noise with a loudspeaker internal to a headphone ear piece and an analog filter with a transfer function. Yet other active noise suppressing headphones use separate microphones paired with separate specified filters or filter hands to reduce ambient noise. The user of these noise suppressing headphones selects through switches, depending on the circumstances, whether the first filter or the second filter is used for noise suppression. Yet other active noise suppressing headphones input ambient noise received at a microphone through an adaptive filter. In these noise suppressing headphones, the adaptive filter output is aligned in with the incidence direction of the ambient noise through the use of an error microphone positioned by a loudspeaker membrane.

SUMMARY

The disclosed active noise suppression headphone system is directed to a headphone system that is capable of substantially suppressing high or low frequency interfering noise that penetrate through a headphone earpiece from multiple directions. An external microphone mounted with a housing of a headphone earpiece senses ambient noise outside of the earpiece. The sensed ambient noise may be processed through at least one parallel filter bank arranged in at least one headphone earpiece. Each parallel filter bank may include adaptively linked filters. The output of these filters may be amplified based on weighting factors that are dependent upon the sensed ambient noise and that are generated by a filtered x least mean square circuit. The amplified filtered outputs may be summed to generate an antinoise signal that is in input to a loudspeaker within the headphone earpiece that substantial suppresses the ambient noise before it can be perceived by an end user of the headphones.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
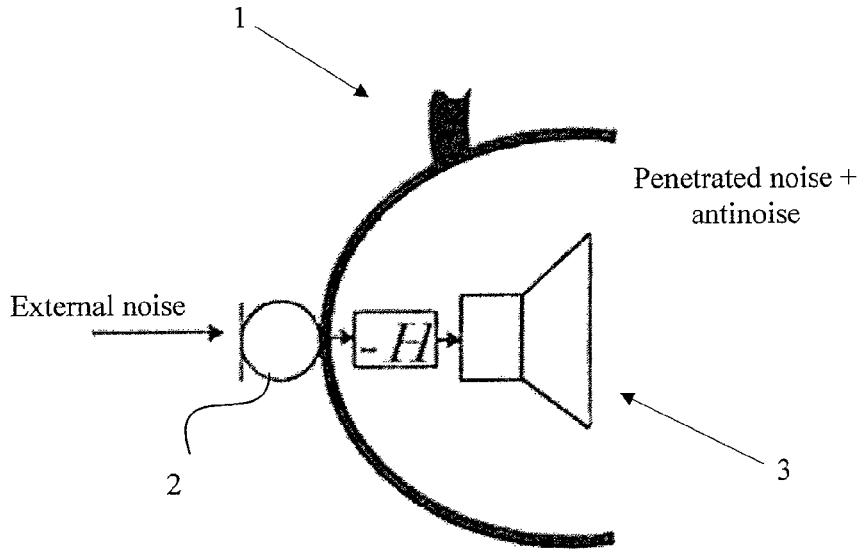
Prior art Fig. 1
FIG. 1 is a representation of a prior art headphone for active noise suppression.

FIG. 1 is a representation of a prior art active noise suppression headphone. In FIG. 1, the headphone includes an earpiece 1 having a housing. A microphone 2 is arranged on the outside of the housing of the earpiece 1 to sense outside noise (interference sound). The sensed outside noise is filtered and inverted by a fixed analog filter II so that noise that penetrates into the earpiece 1 is canceled with an inverted signal ("antinoise") formed by the fixed analog filter Hand reproduced by a loudspeaker 3.

The analog filter H simulates a transfer of sound from the outside of the earpiece 1 to the inside of the earpiece 1. Depending on the direction of incidence of the sensed outside noise, this transition changes. The fixed analog filter H does not account for these changes, and thus limits the suppression of interfering sounds incident upon the earpiece from a direction not accounted for by the fixed filter.

Figure 2:
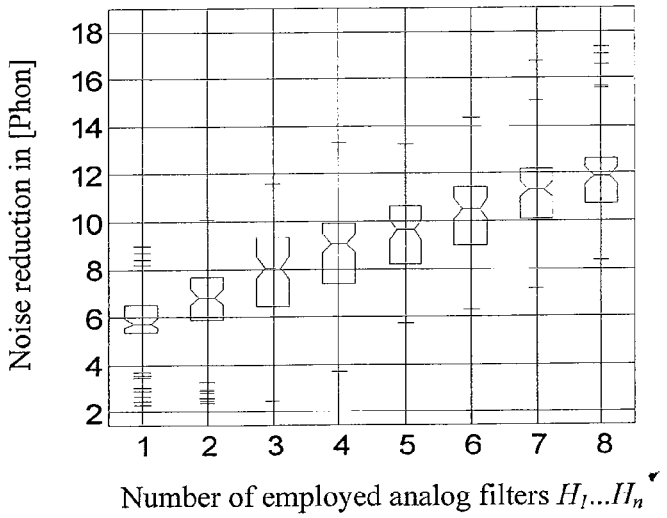
FIG. 2 is a graph illustrating noise reduction of the disclosed active noise suppression headphone apparatus as a function of employed filters.

FIG. 2 is a graph that illustrates an amount of noise reduction of the disclosed active noise suppression headphone apparatus as a function of the number of analog filters H included in the filter bank. In FIG. 2, the x-axis identifies the number of analog filters included in the filter bank. The y-axis illustrates the amount of noise reduction in the units of phon for ambient noise from 85 different directions. Eighty-four of these directions are based on 12 azimuth angles, ranging from about 0 degrees to about 330 degrees, times 7 elevation angles, ranging from about 0 degrees to about 79 degrees, The eighty-fifth direction is from the top. In FIG. 2, hour-glass like shapes identify the Noise Reduction ("NR") levels of approximately 50 percent of the incident noises. The horizontal line passing through each of these shapes denotes the median NR over all directions of incident sound. The remaining horizontal lines in FIG. 2 represent the NR-distribution over all directions except for outliers that in FIG. 2 are present when the number of filters was 1, 2, 7, and 8. When 1 analog filter was employed, NR outliers are the three upper most horizontal bars, and the horizontal bars between 2 and 4 Phons, except for the horizontal bar in this range that is closest to 4 Phons. When 2 analog filters were employed, the NR outliers are the horizontal bars between 2 and 4 Phons, except for the horizontal bar in this range that is closest to 4 Phons. With respect to the use of 7 and 8 analog filters, the outliers are represented by the two highest horizontal bars and the four highest horizontal bars, respectively.

In some configurations, the filter bank may include at least two adaptively linked analog filters H. Some or all of these adaptively linked analog filters H may be adaptively weighted based on different directions of incidence of sensed ambient noises. The adaptability of some or all of these filters based on different directions of incidence of the interfering sound permits adjustment of the "antinoise" to be generated by the loudspeaker of the disclosed active noise suppression headphone apparatus.

Figure 3:
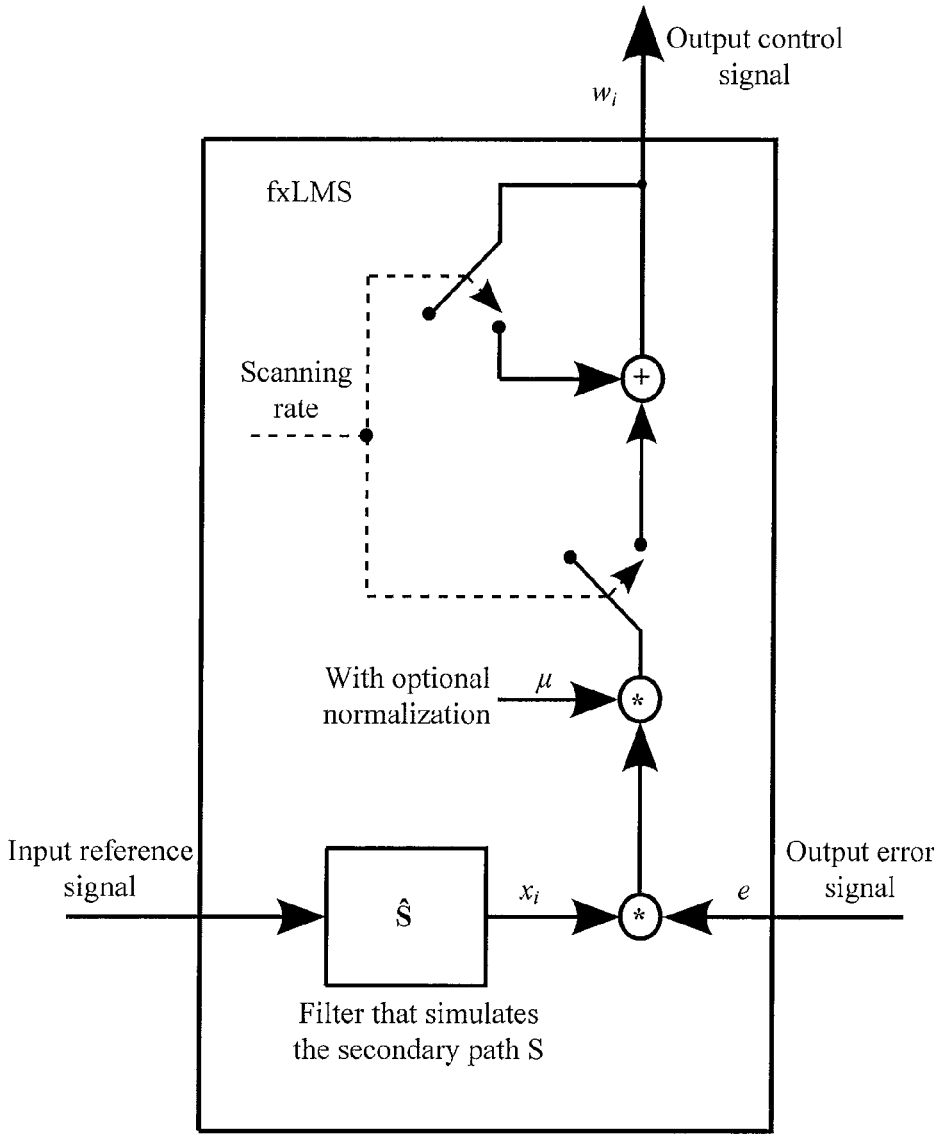
FIG. 3 is a circuit that may implement a Filtered X-Least Means Square algorithm.

FIG. 3 is a circuit that may implement a Filtered X-Least Means Square ("fxLMS") algorithm. The fxLMS algorithm may adjust the parameters of a nonrecursive filter. In FIG. 3, a transfer function $\hat{S}$ may simulate a secondary path S from the loudspeaker 3 input to the error microphone output.

In FIG. 3, the output control signal of the fxLMS circuit is a weight, $w_i$, that controls the amplification of a corresponding filter output. The calculation of the weights $w_i$ occurs recursively according to the fxLMS circuit of FIG. 3. For time n, the calculation is written as follows:

$$w_i[n]=w_i[n-1]+\mu x_i[n]e[n] \quad (1)$$

In equation (1), μ represents a weighting factor, e represents a signal of an error microphone, and $x_i$ is a signal obtained from the corresponding filter output $H_1 \ldots H_n$ and additional filtering with an estimated value $\hat{S}$ of the secondary path S. The weighting factor μ is a multiplicative parameter for the adaption rate. Thus, the greater the weighting factor μ, the more weight that is placed on the current signal change and the current error. In some fxLMS circuit, adaption may occur time-discretely. FIG. 3 illustrates a time-discrete adaptation by use of a switch controlled by a scanning rate. Adaption may also be normalized. Normalized adaptation may occur where the corresponding filter output is divided by the instantaneous signal power of the external microphone.

In some configurations of the disclosed active noise suppression headphone apparatus, the corresponding weights $w_i$ may be calculated in an analog fashion. In other configurations, the calculation of the corresponding weights $w_i$ may occur in a digital fashion. When implemented in a digital fashion, input signals to a fxLMS circuit are preprocessed through an analog-to-digital converter ("A/D" or "ADC") to generate a digital signal. Output signals of a digital fxLMS circuit may be post-processed with a digital-to-analog ("D/A" or "DAC") converter. The configuration of corresponding amplifiers coupled with a fxLMS circuit may determine the format of the weights. For example, where the corresponding amplifiers are voltage-controlled amplifies ("VCA"), the calculated weights w, are formatted as a voltage. However, where the corresponding amplifiers have a different configuration, the calculated weights w, may be formatted to accordingly control the corresponding amplifiers.

Figure 4:
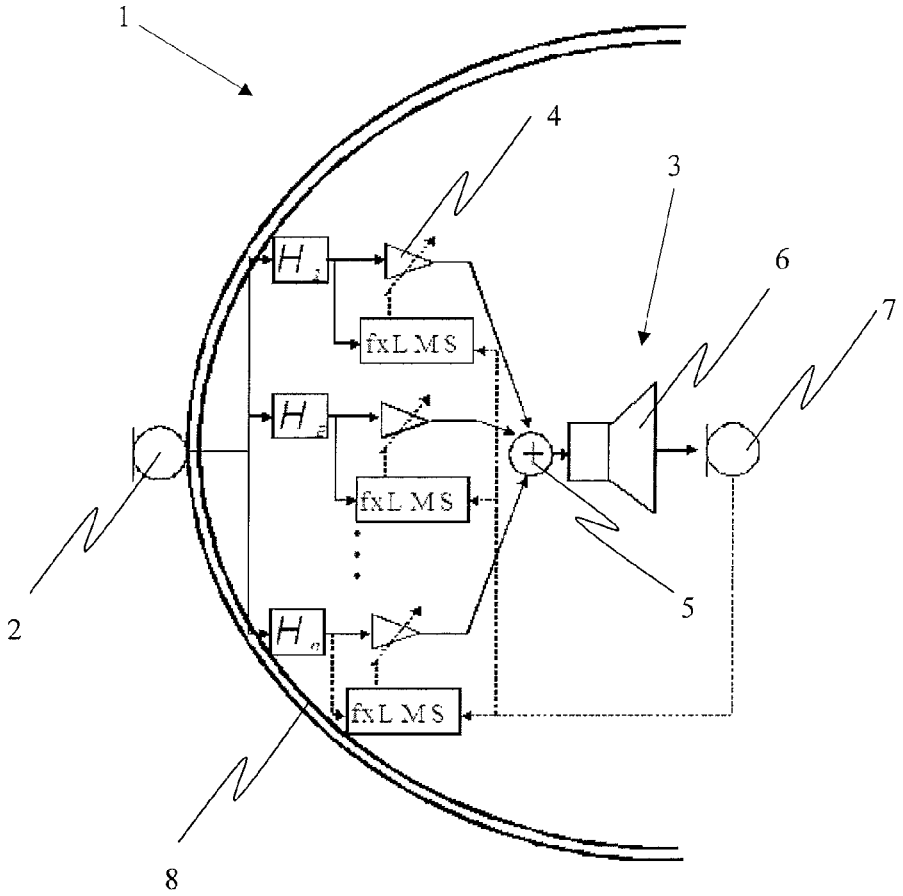
FIG. 4 is an example of an active noise suppression headphone apparatus.

FIG. 4 is an example of an active noise suppression headphone apparatus. In FIG. 4, the active noise suppression ("ANC") headphone apparatus includes an earpiece 1. In some instances, earpiece 1 may be configured to enclose a user's ear. In other instances, earpiece 1 may be configured to be partially inserted into a user's car canal while a portion of the earpiece remains exposed to the environment external to the user's ear canal. Although a single earpiece is illustrated in FIG. 4, two earpieces may be included with the active noise suppression headphone apparatus. Additionally, depending on the circumstances, extender earpieces may be attached to enable multiple end users to listen to the audio signals or other useful signals from the headphones.

Coupled to the earpiece 1 is an external microphone 2. As shown in FIG. 4, the external microphone 2 is coupled to an outside surface of a housing 8 of the earpiece 1. However, in other configurations, the external microphone 2 may be enclosed by the housing 8 but positioned near an interior surface of the housing 8. The exterior microphone 2 may sense ambient noise relative to the earpiece 1. Ambient noise may include undesired sounds from other persons, animals, or things in the vicinity of the earpiece 1. Ambient noise may also include, without limitation, undesired noises relative to the earpiece 1 from sources occurring at a construction site, road noises, noises occurring around or within a vehicle, or in a restaurant. In some instances, the ambient noise may originate from a single source and be incident upon the external microphone 2 from a single direction. In other instances, the ambient noise may originate from a single source but may be incident upon the external microphone 2 from multiple directions due to reflective surfaces in the vicinity of the earpiece 1. In yet other instances, the ambient noise may be a composite noise made up of two or more undesired noises from multiple sources or reflective surfaces relative to the earpiece 1. Regardless of the source or direction of incidence upon the external microphone of the ambient noise, the sensed ambient noise is an interfering sound to the desired audio signal, such as music, audio, or other useful signal, that is to be output by the loudspeaker of the earpiece 1 during playback to a user of the earpiece 1.

In FIG. 4, the exterior microphone 2 transmits a signal to a filter bank of filters. The filters of the filter bank may be digital or analog filters depending on the configuration of additional elements of the active noise suppression headphone. In FIG. 4, the filter bank includes several analog filters $H_1 \ldots H_n$ arranged in a parallel configuration. The output of each filter of the filter bank is adaptively linked to each other. Adaptive linking of the filter banks permits the active noise suppression headphone apparatus to generate an "antinoise" signal, used to substantially reduce or suppress the ambient noise that would otherwise be heard by a user of the earpiece 1, based on ambient noise interfering sounds having one or multiple incidences of direction upon the external microphone 2 or the interfering sound being at a high or low frequency. The generated "antinoise" signal may be substantially inverted to the interfering sound to substantially reduce or substantially suppress it from the perspective of the end user.

Amplification of the filter outputs of the filter bank may be controlled through amplifiers as a function of the direction of the interfering sound sensed by the external microphone 2. In FIG. 4, a plurality of voltage-controlled amplifiers ("VCA") are used to control the amplification of the output of the filter bank filters. More specifically, an amplifier for each corresponding filter of the filter bank is placed in series downstream of the filter and before an adder 5, and is voltage-controlled according to logic that implements a fxLMS algorithm. The amplified filtered outputs are then summed together by an adder 5, and the combined signal is input to loudspeaker 3. The loudspeaker 3 may include a membrane 6 that when vibrated generates an d audio signal that is to be played back to a user of the earpiece 1. The loudspeaker 3 may also be used to generate the antinoise signal.

In the active noise suppression headphone apparatus of FIG. 4, both the outputs of the filter bank and the signals of an error microphone 7 arranged downstream of the loudspeaker 3, and its membrane 6, are used to control the VCAs 4. In this configuration, open loop or feed forward noise suppression is utilized because the interfering sound recorded by the external microphone 2 (i.e., without feedback) is fed through filters $H_1 \ldots H_n$ to membrane 6. In FIG. 4, the fxLMS logic used to control each of the voltage-controlled amplifiers 4 uses as its input signals the output signal of the corresponding analog filter $H_1 \ldots H_n$ and the output signal of the error microphone 7.

In some instances, each earpiece 1 of a pair of headphones may be configured as described with respect to FIG. 4. In other instances, a first earpiece 1 of a headphone set may be configured as described with respect to FIG. 4 while a second earpiece of the headphone set may include a power supply. In this instance, the power supply may be a battery, and may be coupled to the first earpiece through one or more wires.

Figure 5:
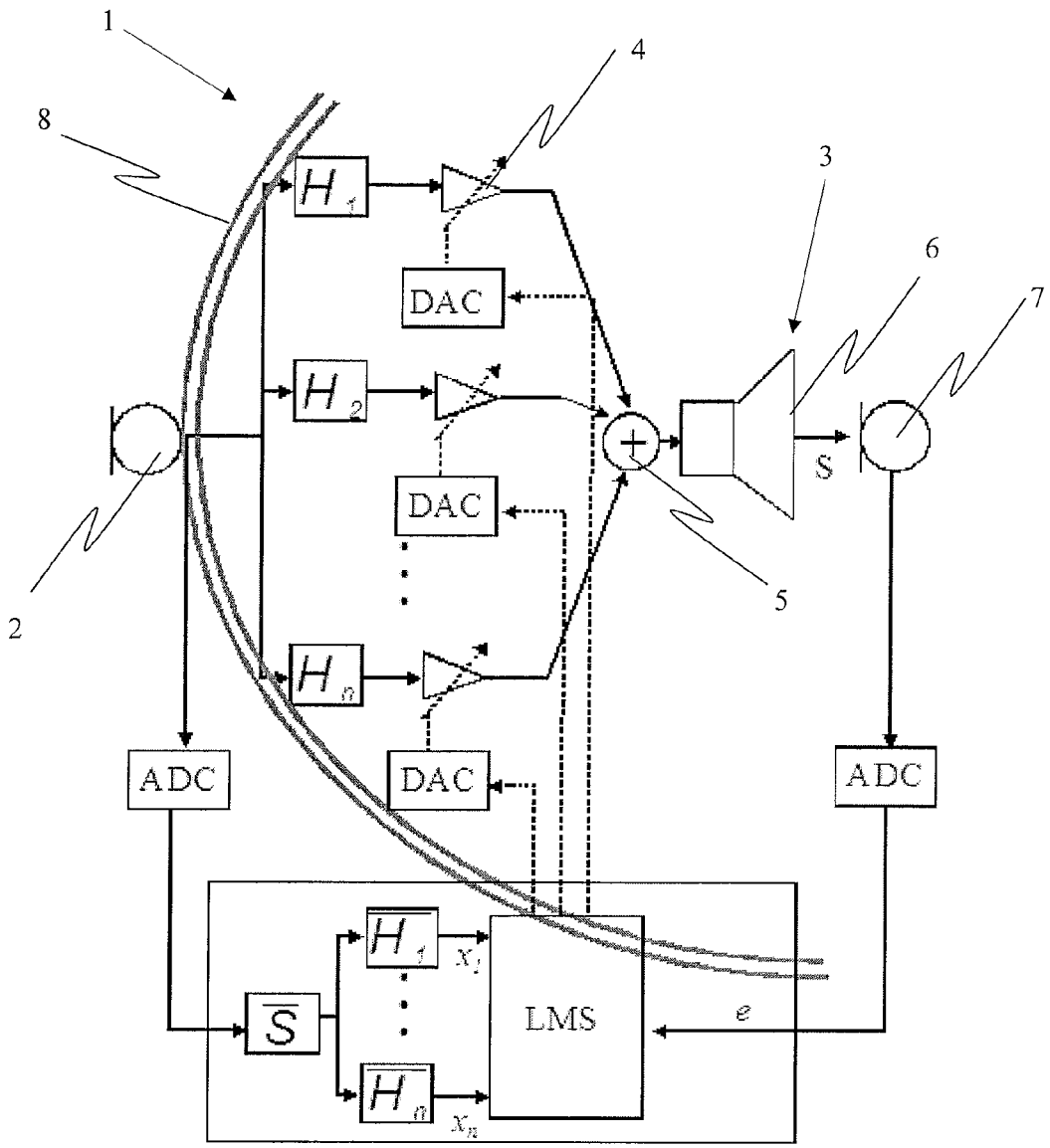
FIG. 5 is an example of an alternate active noise suppression headphone apparatus.

FIG. 5 is an example of an alternate active noise suppression headphone apparatus. The alternate noise suppression headphone apparatus of FIG. 5 includes some like elements which have already been described with respect to FIG. 4. In FIG. 5, the voltage-controlled amplifiers 4 are controlled as a function of the digitized input signal of the external microphone 2, digitally simulated filters $\overline{H_1} \ldots \overline{H_n}$, a digitally simulated secondary path $\overline{S}$ and a digitized error signal e of the error microphone 7.

The digitized signal from the external microphone 2 is generated with an analog-to-digital converter, ADC. This digitized input signal serves as an input signal for the digitally simulated secondary path $\overline{S}$, whose output signal subsequently serves as the input signal to the digitally simulated filters $\overline{H_1} \ldots \overline{H_n}$. The output of these digitally simulated filters, $x_i \ldots x_n$, along with the digitized error signal e control the weights $w_i$ generated by logic implementing a fxLMS algorithm according to formula (I). These weights $w_i$ undergo a digital-to-analog conversion through a digital-to-analog converter ("DAC") to create analog signals. In FIG. 5, the weights $w_i$ represent voltages that are input to the voltage-controlled amplifiers 4 of the corresponding filter outputs. In configurations where the amplifiers use a different format control parameter, the weights w, may be processed to obtain the appropriately formatted control parameter. The outputs of the voltage-controlled amplifiers 4 are input to the adder 5, and the combined signal in subsequently input to loudspeaker 3.

In some configurations, an active noise suppression headphone apparatus may be configured to substantially suppress or reduce ambient noise in which the apparatus includes a plurality of earpieces each having a housing. An external microphone may be mounted with the housing of each earpiece, and each external microphone may be configured to sense the ambient noise relative to the headphone apparatus. Each external microphone may be coupled with a parallel bank of at least two adaptively linked analog filters. Each earpiece may also include a loudspeaker. Signals output from each external microphone may be input through a simulation of a secondary path. This secondary path simulation may represent a propagation of some ambient noise through the earpiece. The signals output from each external microphone may also be input to the respective parallel filter banks, and to a fxLMS circuit. A further input to the fxLMS input may be an error signal that is output by an error microphone position within each respective earpiece and downstream from its respective loudspeaker. The output of the fxLMS circuit may control amplifiers paired with the adaptively linked analog filters of the parallel filter banks. When these amplifiers are voltage-controlled amplifiers, the output of the fxLMS circuit may be a voltage. Where alternate types of amplifiers are used, the signal output from the fxLMS circuit may be a like type such that it may be used to control the amplifiers. The output of the amplifiers in each earpiece may be input to an adder, and the combined signal input to the loudspeaker of that earpiece.

In some configurations of the active noise suppression headphone apparatus of this disclosure, different frequency bands (for example, critical bandwidths in the range from about 20 Hz to about 2 kHz) can also be used so that specific frequency ranges of sensed ambient noise can be weighted separately from ambient noise sensed from specific directions.

Figure 7:
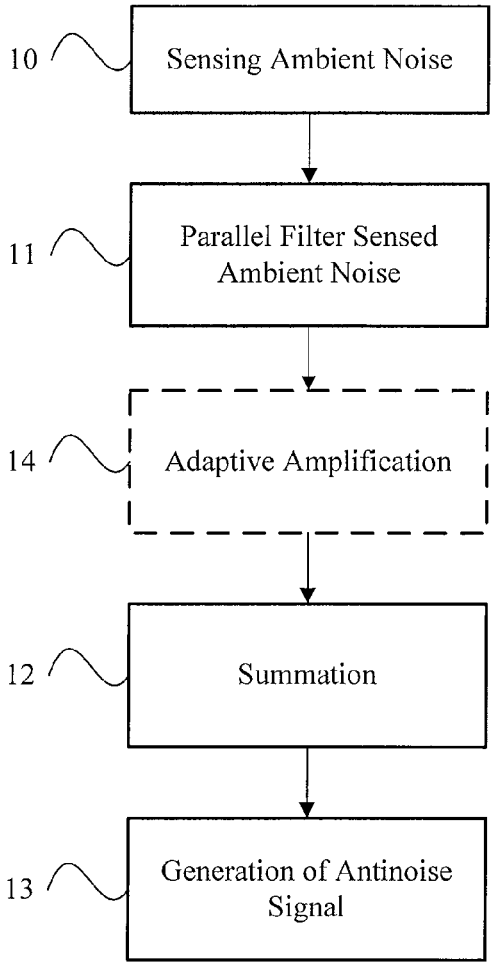
FIG. 7 is a flow diagram for active noise suppression in a headphone.

FIG. 7 is a flow diagram for active noise suppression in a headphone. At act 10, ambient noise to the headphone is sensed. The ambient noise may be detected sensed through an external microphone mounted with one or more earpieces of the headphone. At act 11, the sensed ambient noise is passed through at least two adaptively linked analog filters. These adaptively linked analog filters may be arranged in parallel. These analog filters may modify the sensed ambient noise signal, for example, by inversion of the sensed ambient noise. In some configurations, the filters of the parallel filter bank may correspond to different interference transfer functions between the external microphone and an error microphone of the headphone. In other configurations, the filters of the parallel filter bank may correspond to different secondary path compensations from the external microphone to the error microphone.

Summation of each of the filtered ambient noise signals may occur at act 12. At act 14 the summed signal may be input to a loudspeaker positioned with the earpiece of the headphone to generate the antinoise signal. The antinoise signal output by the loudspeaker may substantially reduce or suppress some or all of the ambient noise components that penetrate through the headphone earpiece before these penetrating signal are perceived by an end user of the headphones.

Before summation of the filtered sensed ambient noise, the filtered output signals may be amplified. One manner in which these filtered output signals may be amplified is with the use of adaptive amplifiers, such as a voltage-controlled amplifier. The voltage-controlled amplifier may be controlled by weighting factors that are dependent upon the sensed ambient noise. In some situations, the weighting factors may be dependent upon a direction of incidence of the ambient noise sensed by the external microphone. The amplifier weighting factors may be generated through the use of a filtered x least means square (fxLMS) circuit. In some configurations, the filtered x least means square circuit may be implemented through the use of analog components, whereas in other configurations, the filtered x least means square circuit may be implemented digitally.

When implemented with analog components, the inputs to the fxLMS circuit may include the output of the filtered sensed ambient noise and an error signal generated by an error microphone downstream of the loudspeaker that is positioned within the headphone earpiece. In yet other configurations, the inputs to the fxLMS circuit may include a signal that passed through a simulated secondary path and a parallel bank of at least two adaptively linked analog filters as well as the error signal derived from the error microphone. In a digital configuration, the inputs to a digital fxLMS circuit may include a digitized version of the sensed ambient noise that is passed through a digitally simulated secondary path and a digital filter simulation of the at least two adaptively linked analog filters, as well as a digitized version of the error signal from the error microphone.

The below exemplary calculations, and rounding, explain the effectiveness of the disclosed active noise suppression headphone apparatus. The residual noise resulting after active noise suppression is the noise that has penetrated the earpiece minus the antinoise generated by the active noise suppression headphone apparatus and which is output by loudspeaker 3. The following situation is therefore obtained in the spectral range for the residual noise spectrum E at any time:

$$E=XK-XH=(K-H)X \tag{2}$$

where X is the spectrum of the interfering sound signal x recorded on the outside of the earpiece 1, K the transfer function of the interfering sound from the outside of the earpiece 1 inward, and H is the analog filter which simulates the transfer function. Normalization of the residual noise energy to the input signal energy leads to:

$$\frac{\|E\|^2}{\|X\|^2} = \|K - H\|^2 \tag{3}$$

Equation (2) illustrates that a residual noise spectrum E resulting after noise suppression may be calculated from a transfer function K, the received interference signal spectrum X, the analog filters $H_1 \ldots H_n$, and their corresponding weightings $w_1 \ldots w_n$:

$$E = \left(K - \sum_{i=1}^{n} w_i H_i\right) X \tag{4}$$

The residual noise spectrum E and the extent of active noise suppression is calculated below, for exemplary purposes only, at a frequency $f_{example}$=500 Hz. For this frequency, the amplitude and phase of two different transfer functions ($K_1$ and $K_2$) and for a fixed filter and two adaptively linkable parallel filters are provided in Table 1.

TABLE 1

Amplitude and phase of two different transfer functions ($K_1$ and $K_2$).

| | Amplitude | Amplitude (dB) | Phase (°) | Complex-valued representation |
|---|---|---|---|---|
| $K_1$ | 0.86 | −1 dB | −45.94° | 0.6 − j0.62 |
| $K_2$ | 1.14 | 1 dB | −20.46° | 1.072 − j0.4 |
| Fixed filter | 0.7 | −3 dB | −44.13° | 0.5 − j0.485 |
| Parallel filter 1 | 1.96 | 6 dB | −44.38° | 1.4 − j1.37 |
| Parallel filter 2 | 1.82 | 5.5 dB | −135.67° | −1.3 − j1.27 |

Practical Example 1

First Case

A fixed filter with the transfer function $K_1$:

For the transfer function $K_1$ with the fixed ANC filter at $f_{example}$, the residual noise spectrum is: $E(f_{example})$ =(0.6−j0.62)−(0.5−j0.485)=0.1−j0.135.

This corresponds to residual noise at −15.5 dB. In comparison with the −1 dB purely passive attenuation by the transfer function $K_1$, this means that there is active noise suppression of −1 dB+15.5 dB=14.5 dB.

Second Case

A fixed filter with the transfer function $K_2$:

For the transfer function $K_2$ with the fixed ANC filter, the residual noise spectrum is:

$$E(f_{example})=(1.072-j0.4)-(0.5-j0.485)=0.572+j0.085.$$

This corresponds to residual noise at −4.7 dB or an active noise suppression of +1 dB+4.7 dB=5.7 dB.

Both of the above cases use fixed filters. The amount of active noise suppression varies depending on the configuration of the utilized fixed filter.

Figure 6:
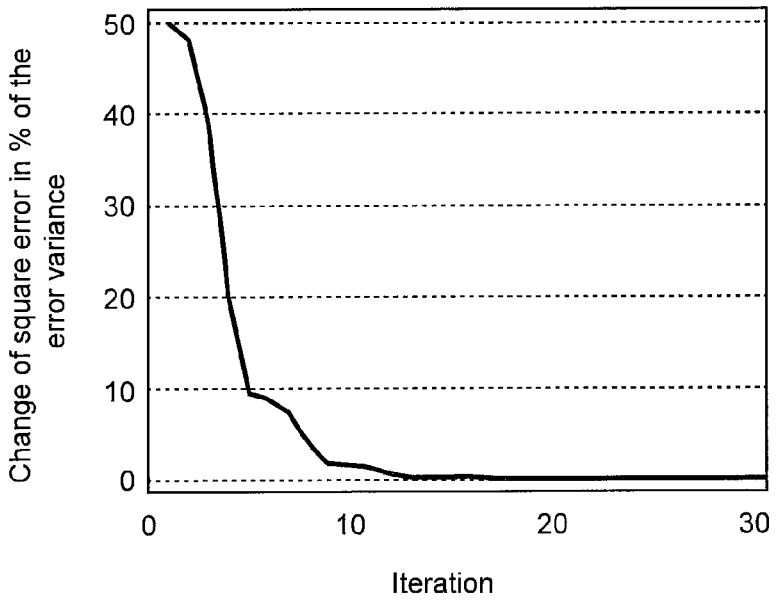
FIG. 6 is a graph showing a relationship between the number of iterations of filter weight calculations and the change in square error of a fxLMS algorithm.

In the following two exemplary calculations, two adaptively linked parallel filters are used. The adaptability of these filters continues until it is determined that convergence of the fxLMS algorithm is reached. The adaption of the fxLMS algorithm may be considered converged, when the change in square error remains below about 1% of the total error variance. A relation between the number of iterations and the change in square error diminishing with increasing number of iterations is shown in FIG. 6. FIG. 6 illustrates that after a total of about 12 iterations (recursions) the change in square error is less than about 1% of the total error variance.

Practical Example 2

First Case

Two adaptively linkable parallel filters with the transfer function

For a cosine at 500 Hz, a scanning rate of 4000 Hz, an initial filter application of 0.37 and 0.1 and a weighting factor of μu=0.1 the first three recursions are calculated as follows with the fxLMS algorithm:

First recursions: ρ=0°

The noise sensed at the external microphone amounts to:

$$x=\cos(\rho)=)\cos(0°)=1$$

and the noise that penetrates into the earpiece amounts to:

$$x_{in}=\|K_1\|*\cos(\rho+\arg(K_1))=0.86*\cos(0°-45.94°)=0.6.$$

The antinoise y amounts to:

$$y=-w_1*\|H_1\|*\cos(\rho+\arg(H_1))-w_2*\|H_2\|*\cos(\rho+\arg(H_2))$$

$$y=-0.37*1.96\cos(0°-44.38°)-0.1*1.82\cos(0°-135.67°)=-0.4$$

From which it follows that:

$$e = x_{in} + y = 0.2$$

$$w_{1,neu} = w_1 + \mu * \|H_1\| * \cos(\rho + \arg(H_1)) * e = 0.37 + 0.1 * 1.96\cos(0° - 44.38°) * 0.2 = 0.4$$

-continued $$w_{2,neu} = w_2 + \mu * \|H_2\| * \cos(\rho + \arg(H_2)) * e = 0.1 + 0.1 * 1.82\cos(0° - 135.67°) * 0.2 = 0.07$$

Second recursion: ρ=45°

$x$=cos(45°)=0.7

$x_{in}$=0.86

$y$=−0.4*1.96 cos(45°−44.38°)−0.07*1.82 cos(45°−135.67°)=−0.78 e=0.08

$w_1$=0.4+0.1*1.96 cos(45°−44.38°)*0.08=0.42

$w_2$=0.07+0.1*1.82 cos(45°−135.67°)*0.08=0.07

Third recursion: ρ=90°

$x$=cos(90°)=0

$x_{in}$=0.62

$y$=0.42*1.96 cos(90°−44.38°)−0.07*1.82 cos(90°−135.67°)=−0.66

$e$=−0.04

$w_1$=0.42+0.1*1.96 cos(90°−44.38°)*−0.04=0.41

$w_2$=0.07+0.1*1.82 cos(90°−135.67°)*−0.04=0.07

After 12 recursions the change in square errors is less than about 1% of the total error variance. The filter weights converge to $w_1$=0.43 and $W_2$=0.02. The residual noise spectrum resulting from this at the example frequency is:

$E(f_{example})$=(0.6−$j$0.62)−0.43(1.4−$j$1.37)−0.02(−1.3−$j$1.27)=0.02.

This corresponds to a residual noise of −36 dB or an active noise suppression of: −1 dB+36 dB=35 dB.

Second Case

Two adaptively linkable parallel filters with a transfer function $K_2$:

The transfer function of the interfering sound changes to $K_2$. Adaption is continued from the previously converged filter weights.

First recursion: ρ=0°

$x$=cos(0)=1

$x_{in}$=1.14*cos(0°−20.46°)=1.1

$y$=−0.43*1.96 cos(0°−44.38°)−0.02*1.82 cos(0°−135.67°)=−0.58

$e$=$x_{in}$+$y$=0.49

$w_{1,neu}$=0.43+0.1*1.96 cos(0°−44.38°)*0.49=0.5

$w_{2,neu}$=0.02+0.1*1.82 cos(0°−135.67°)*0.49=−0.04

Second recursion: ρ=45°

$x$=cos(45°)=0.7

$x_{in}$=1.04

$y$=−0.5*1.96 cos(45°−44.38°)+0.04*1.82 cos(45°−135.67°)=−0.99 e=0.05

$w_1$=0.5+0.1*1.96 cos(45°−44.38°)*0.05=0.51

$w_2$=−0.04+0.1*1.82 cos(45°−135.67°)*0.05=−0.04

Third recursion: ρ=90°

$x$=cos(90°)=0

$x_{in}$=0.4

$y$=−0.51*1.96 cos(90°−44.38°)+0.04*1.82 cos(90°−135.67°)=−0.65

$e$=−0.25

$w_1$=0.51+0.1*1.96 cos(90°−44.38°)*−0.25=0.48

$w_2$=0.04+0.1*1.82 cos(90°−135.67°)*−0.25=−0.08

After 12 recursions the square error remains below 1% of the total error variance. The filter weights converge subsequently to $w_1$=0.52 and $w_2$=−0.23. The following residual noise spectrum and the following ANC result from this:

$E(f_{example})$(1.72−$j$0.4)−0.25(1.4−$j$1.37)+0.23(4.3−$j$1.27)=0.045−$j$0.013.

This corresponds to a residual noise of −26.6 dB and active noise suppression of +1 dB+26.6 dB=27.6 dB.

With the two adaptively linkable parallel filters, regardless of the two transfer functions $K_1$ and $K_2$, active noise suppression of 27.6 dB is therefore achieved.

While various embodiments have been described, it will be apparent to those of ordinary skill in the art that many more embodiments and implementations are possible and within the scope of what is describe. Accordingly, there should be no restrictions, except in light of the attached claims and their equivalents.

We claim:

1. An active noise suppression headphone apparatus, comprising:

an earpiece having a housing;

an external microphone mounted with the housing, the external microphone configured to sense ambient noise outside of the housing;

a loudspeaker positioned within the housing; and a parallel filter bank including at least two adaptively linked filters, where an output of each of the at least two adaptively linked filters are coupled to an adder, and where an output of the adder is coupled to the loudspeaker, and an adjustable amplifier bank that includes an adjustable amplifier for each of the at least two adaptively linked filters, and where a corresponding adjustable amplifier is serially positioned between the adaptively linked filters of the parallel filter bank and the adder, and further where each adjustable amplifier is weighted depending on a direction of incidence of the ambient noise sensed by the external microphone.

2. The active noise suppression headphone apparatus of claim 1, where the at least two adaptively linked filters comprise analog filters.

3. The active noise suppression headphone apparatus of claim 1, where the adjustable amplifier bank comprises voltage-controlled amplifiers.

4. The active noise suppression headphone apparatus of claim 1, further comprising an error microphone positioned within the housing and downstream of an output of the loudspeaker, where the error microphone feeds an error signal to a fxLMS circuit that is coupled to the adjustable amplifier bank.

5. The active noise suppression headphone apparatus of claim 1, further comprising:

a voltage-controlled amplifier bank that includes a plurality of adjustable amplifiers; and an error microphone positioned within the housing and downstream of an output of the loudspeaker, where each adjustable amplifier is weighted depending on the direction of incidence of the ambient noise sensed by the external microphone; and where the error microphone is coupled to a fxLMS circuit that is coupled to the voltage-controlled amplifier bank.

6. A method for active noise suppression in a headphone, comprising:

sensing an ambient noise with an external microphone mounted with a headphone earpiece;

passing the sensed ambient noise through at least two adaptively linked analog filters;

amplifying each of the filtered ambient noise signals with corresponding voltage-controlled amplifiers that are weighted depending on a direction of incidence of the ambient noise sensed by the external microphone;

summing an output of the filtered signals to generate an antinoise signal; and inputting the antinoise signal to a loudspeaker positioned within the headphone earpiece.

7. The method of claim 6, where each corresponding voltage-controlled amplifier is controlled by an fxLMS algorithm based on an error feedback signals of an error microphone and the filtered ambient noise signals.

8. The method of claim 6, where the weighting of each voltage-controlled amplifiers comprises a weighting factor (.mu.), an error signal (e) of an error microphone, and an intermediate signal obtained from the corresponding filtered ambient noise signals and a filter with an estimated value of a secondary path.

9. The method of claim 6, where a residual noise spectrum resulting after noise suppression consists of a transfer function of the external microphone to an error microphone downstream of the loudspeaker, the transfer function represented by of a received interference signal spectrum (X), analog filters ($H_1 \ldots H_n$) and the corresponding weightings ($w_1 \ldots w_n$) to:

$$E = \left(K - \sum_{i=1}^{n} w_1 H_1\right) X$$

where X represents a received interference signal spectrum, $H_1 \ldots H_n$ represents the adaptively linked analog filters, and $w_1 \ldots w_n$ represents the corresponding weight of the voltage-controlled amplifiers.

10. A method for active noise suppression in a headphone, comprising:

sensing an ambient noise with an external microphone counted with a headphone earpiece;

passing the sensed ambient noise through at least two adaptively linked analog filters;

summing an output of the filtered signals to generate an antinoise signal;

inputting the antinoise signal to a loudspeaker positioned within the headphone earpiece;

receiving an error signal from an error microphone positioned downstream of the loudspeaker in the headphone earpiece, digitizing the sensed ambient noise and passing it through a digitally simulated secondary path and passing the output through a digital filter simulation of the at least two adaptively linked analog filters; and driving a digital fxLMS circuit with the output of the digital filter simulation and a digitized error signal to generate weights that control voltage-controlled amplifiers that amplify the output of at least two adaptively linked analog filters before the summing act.

11. A method for active noise suppression in a headphone, comprising:

sensing an ambient noise with an external microphone counted with a headphone earpiece;

passing the sensed ambient noise through a first filter bank of at least two adaptively linked analog filters;

summing an output of the filtered signals to generate an antinoise signal;

inputting the antinoise signal to a loudspeaker positioned within the headphone earpiece;

receiving an error signal from an error microphone positioned downstream of the loudspeaker in the headphone earpiece, passing the sensed ambient noise through a simulated secondary path and a second filter bank of at least two adaptively linked analog filters; and driving a fxLMS circuit with the outputs of the second filter bank and an error signal to generate weights that control voltage-controlled amplifiers that amplify the output of the first filter bank of at least two adaptively linked analog filters before the summing act.

12. The method of claim 11, where the at least two adaptively linked analog filters of the first filter bank comprise different interference transfer functions from the external microphone to the error microphone.

13. The method of claim 11, where the at least two adaptively linked analog filters of the first filter bank comprise different secondary path compensations from the external microphone to the error microphone.

* * * * *